US007757372B2

(12) United States Patent
Bytow et al.

(10) Patent No.: US 7,757,372 B2
(45) Date of Patent: Jul. 20, 2010

(54) SHEET METAL PROCESSING METHODS UTILIZING A COMBINED PUNCHING AND FORMING MACHINE

(75) Inventors: Peter Bytow, Simmozheim (DE); Christoph Hammer, Ludwigsburg (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 469 days.

(21) Appl. No.: 10/943,159

(22) Filed: Sep. 17, 2004

(65) Prior Publication Data

US 2005/0107891 A1 May 19, 2005

(30) Foreign Application Priority Data

Sep. 18, 2003 (EP) ..... 03021065

(51) Int. Cl.
*B23P 13/04* (2006.01)

(52) U.S. Cl. ..... 29/558; 29/527.2; 29/557; 29/563; 72/332; 72/333; 72/335

(58) Field of Classification Search ..... 29/572.2, 29/557, 558, 563, DIG. 37; 72/416, 407, 72/335, 20.3, 38; 83/140
See application file for complete search history.

(56) References Cited

U.S. PATENT DOCUMENTS

| | | | | |
|---|---|---|---|---|
| 2,173,730 | A * | 9/1939 | Schmied | 83/140 |
| 2,313,525 | A | 3/1943 | Edelman | |
| 3,584,487 | A * | 6/1971 | Carlson | 72/38 |
| 3,756,051 | A * | 9/1973 | Rebsamen et al. | 72/20.3 |
| 4,400,965 | A * | 8/1983 | Schey | 72/334 |
| 4,977,804 | A | 12/1990 | Naito | |
| 5,361,660 | A | 11/1994 | Tsubota | |
| 6,454,052 | B2 | 9/2002 | Wu | |

FOREIGN PATENT DOCUMENTS

| | | |
|---|---|---|
| DE | 295 07 141 | 8/1995 |
| DE | 195 17 109 | 11/1996 |
| DE | 3943747 | 5/2000 |
| DE | 19944722 | 4/2001 |
| DE | 10023881 | 11/2001 |
| EP | 0 530 008 | 3/1993 |
| EP | 0 757 926 | 2/1997 |
| EP | 0 979 691 | 2/2000 |
| JP | 2000-005832 | 1/2000 |

* cited by examiner

*Primary Examiner*—Rick K Chang
(74) *Attorney, Agent, or Firm*—Fish & Richardson P.C.

(57) ABSTRACT

A method of processing a sheet metal sheet with a combined punching and forming machine includes spraying a lubricant onto on a lower side of the sheet metal sheet in a first forming position on the sheet, forming the sheet metal sheet at the first forming position with a first forming tool, and forming the sheet metal sheet with the second forming tool at a second forming position on the sheet metal sheet after spraying the lubricant onto the first forming position and before forming the sheet metal sheet at the first forming position.

15 Claims, 2 Drawing Sheets

SHEET METAL PROCESSING METHODS UTILIZING A COMBINED PUNCHING AND FORMING MACHINE

CLAIM OF PRIORITY

This application claims priority under 35 USC §119(a) to European patent application, serial number EP 03 021 065.2, filed on Sep. 18, 2003, the entire contents of which is hereby incorporated by reference.

TECHNICAL FIELD

The present invention relates the to processing of a flat metallic material (e.g., sheet metal), and, more particularly, to a combined metal punching and forming.

BACKGROUND

Sheet metal is generally formed by a forming tool that includes two forming tool halves (e.g., a male mold and a female mold). The forming tool halves contact the sheet metal to be formed during forming and exert a force on the sheet metal, which causes the sheet metal to change its shape. A relative motion between the sheet metal to be formed and the forming tool halves is generated during shaping. Abutment of the sheet metal to be formed on the forming tool halves produces frictional forces that are reduced through application of lubricant on the sheet metal to be formed or on the forming tool halves. Normally, only the upper forming tool (e.g., the male mold) is lubricated during processing of the sheet metal, because the lower forming tool (e.g., the female mold) is covered by the sheet metal and therefore is not readily accessible. For this reason, the lower side of the sheet metal normally is lubricated manually on the processing positions to be formed when it is outside of the forming machine. However, this is very time-consuming and environmentally burdensome because excessive lubrication often must be used.

Thus, a combined punching and forming machine and a processing method that provide lubrications of the sheet metal during processing is desired, as is a computer program (e.g., software) for corresponding computer control of the combined punching and forming machine.

The computer program product can be a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

SUMMARY

In a processing method, lubricants are applied onto a first position of a sheet metal sheet using a spray device disposed at a lateral distance from a punching tool or a forming tool. Then, between the lubrication and the forming of this first position on the sheet, at least one processing step is carried out another position on the sheet metal sheet.

A lubricant (e.g., an air-oil mixture) is sprayed onto a position on a sheet metal sheet to be formed at a distance from a working location of the forming tool, and this lubricated metal position is subsequently moved to the processing tool. The sequence of multiple processing steps (i.e., punching and forming) at different positions on the sheet metal sheet is selected such that the overall processing time is as short as possible or is optimized in terms of time, and, in particular, is shorter than if each lubricated position of the sheet metal sheet were formed directly after lubrication of the position.

If the method also includes the processing step of lubricating a sheet metal position to be punched, between the lubrication and formation of this sheet metal position, at least one processing step is carried out at another position on the sheet metal sheet. The sequence of multiple processing steps is selected such that the overall processing time is as short as possible or optimized in terms of time, and in particular, shorter than if a sheet metal position is punched directly after lubrication of this position.

Between forming or punching of two lubricated sheet metal positions, a limited number of forming or punching processes of non-lubricated sheet metal positions can be carried out to optimize the number of lubrications. For example, lubrication only of every second or third forming or punching process may be sufficient.

To reduce soiling of the machine by the lubricant, repositioning between lubrication and the associated forming or punching should be limited. For this reason, between lubricating and forming or punching of the same position on a sheet metal sheet only a limited number of processing steps are preferably carried out at other positions.

All processing steps that can be performed without changing tools can be carried out successively, and a sheet metal position can be formed or punched only after application of the lubricant.

The position on a sheet metal sheet to be subsequently processed is generally the position that can be reached within the least amount of time from the current sheet metal position, while taking into consideration the following boundary conditions: a) only those sheet metal positions can be selected that can be processed without changing tools; and b) sheet metal positions are available for forming or punching only after previous lubrication.

It is, however, also possible to select lubricating positions of a subsequent processing (e.g., after a tool change) or even all lubricating positions that exist during the entire treatment of the sheet metal, as the subsequent sheet metal position to be processed.

The processes described herein can be implemented using a combined punching and forming machine that includes mutually exchangeable punching and forming tools for processing a movable sheet metal sheet and a spray device that is disposed at a lateral distance from the exchanged punching or forming tool and that is adapted for applying lubricant onto the sheet metal sheet. The spray device can serve to lubricate the lower side of the sheet metal sheet but may alternatively or additionally be disposed above the sheet metal sheet.

The spray device permits precise lubrication of the lower side of the processed sheet metal sheet and therefore of the lower molding tool half (i.e., the female mold). In combined punching and forming machines with a rigid slide for discharging punched parts, the spray device or the spray nozzle thereof may preferably be provided on the upper part of the rigid slide laterally in front of the female mold receptacle.

A computer program (e.g., implemented in software) can be used for generating a control program for controlling a combined punching and forming machine in accordance with the above methods described herein.

In a first general aspect, a method of processing a sheet metal sheet with a combined punching and forming machine includes spraying a lubricant onto on a lower side of the sheet metal sheet in a first forming position on the sheet, forming the sheet metal sheet at the first forming position with a first forming tool, and forming the sheet metal sheet with the second forming tool at a second forming position on the sheet metal sheet after spraying the lubricant onto the first forming position and before forming the sheet metal sheet at the first forming position.

Implementations may include one or more of the following features. The method can further include spraying a lubricant onto on a lower side of the sheet metal sheet in a first punching position on the sheet, punching the sheet metal sheet at the first punching position with a first punching tool, and punching the sheet metal sheet with the second punching tool at a second punching position on the sheet metal sheet after spraying the lubricant onto the first punching position and before punching the sheet metal sheet at the first punching position.

The method can further include punching the sheet metal sheet at a plurality of positions, forming the sheet metal sheet at a plurality of positions, lubricating the sheet metal sheet at a first lubricated position and at a second lubricated position, forming or punching the sheet metal sheet at the first lubricated position and at the second lubricated position, and between forming or punching of the sheet at the first lubricated position and at the second lubricated position, forming the sheet metal sheet at a plurality of positions, more than one-third of which have been lubricated.

The method can further include forming the sheet metal sheet at a plurality of positions on the sheet metal sheet without changing forming tools. The method can further include punching the sheet metal sheet at a plurality of positions on the sheet metal sheet without changing tools. The method can further include forming the sheet metal sheet at a plurality of positions on the sheet metal sheet without changing tools, and performing consecutively all the punching and forming steps that can be carried out without changing tools. The method can further include spraying a lubricant onto a lower side of the sheet metal sheet in a position to be punched, spraying a lubricant onto a lower side of the sheet metal sheet in a position to be formed, forming the sheet metal sheet at a plurality of positions to be formed on the sheet metal sheet only after application of lubricant to the positions to be formed, and punching the sheet metal sheet at a plurality of positions to be punched on the sheet metal sheet only after application of lubricant to the positions to be punched.

The method can further include selecting a subsequent position to be processed on the sheet metal sheet that can be reached within the shortest amount of time from a current sheet metal position being processed as the next position on the sheet metal sheet to be processed. The method can further include lubricating the sheet metal sheet at a first lubricated position and at a second lubricated position, and between forming or punching the sheet metal sheet at a first lubricated position and at a second lubricated position, forming the sheet metal sheet at a plurality of positions, more than one-third of which have been lubricated, punching the sheet metal sheet at a plurality of positions on the sheet metal sheet without changing punching tools, forming the sheet metal sheet at a plurality of positions on the sheet metal sheet without changing forming tools, performing consecutively all the punching and forming steps that can be carried out without changing tools, forming the sheet metal sheet at a position to be formed on the sheet metal sheet only after application of lubricant to the position, punching the sheet metal sheet at a position to be punched on the sheet metal sheet only after application of lubricant to the position, and selecting a subsequent position to be processed on the sheet metal sheet that can be reached within the shortest amount of time from a current sheet metal position being processes as the next position on the sheet metal sheet to be processed.

In another general aspect, a combined punching and forming machine include mutually exchangeable punching tools for punching a movable sheet metal sheet, mutually exchangeable forming tools for forming a movable sheet metal, and a spray device disposed at a lateral distance from an exchangeable punching tool or forming tool for spraying a lubricant onto on a lower side of the sheet metal sheet in a first forming position on the sheet. The machine is adapted for forming the sheet metal sheet with a second forming tool at a second forming position on the sheet metal sheet after the spray device has sprayed the lubricant onto a first forming position and the sheet metal sheet is formed at a first forming position with a first forming tool. Implementations can include one or more of the following features. For example, the spray device can be disposed below the sheet metal sheet. The machine can further include a control program for controlling a combined punching and forming machine to perform the method of claim 1.

In another general aspect, a computer program includes instructions that, when executed, control a combined punching and forming machine to spray a lubricant onto on a lower side of the sheet metal sheet in a first forming position on the sheet, form the sheet metal sheet at the first forming position with a first forming tool, and form the sheet metal sheet with the second forming tool at a second forming position on the sheet metal sheet after spraying the lubricant onto the first forming position and before forming the sheet metal sheet at the first forming position.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
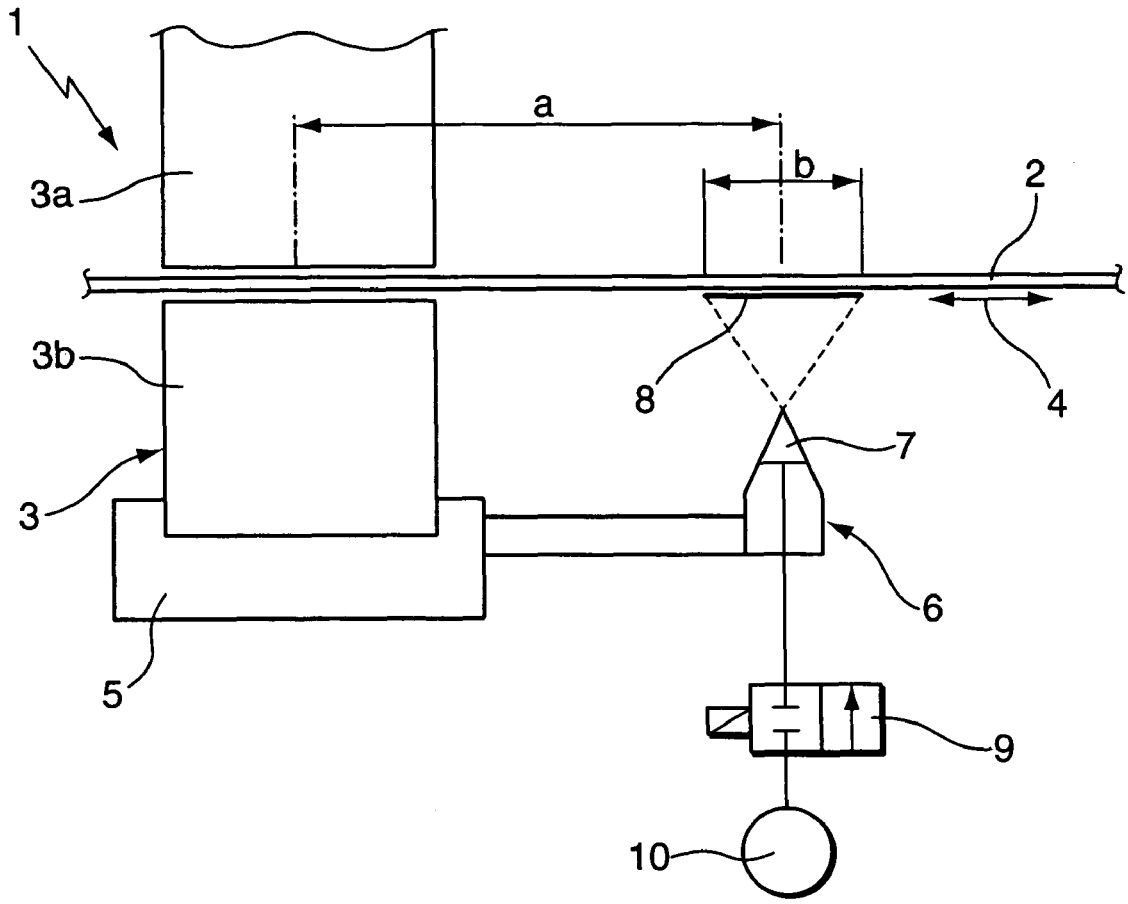
FIG. 1 is a schematic side view of a combined punching and forming machine.

The combined punching and forming machine 1 shown in FIG. 1 includes exchangeable punching and forming tools for processing a sheet metal sheet 2 that is moved in the machine 1 in a direction indicated by a double arrow 4 past a working location of the mounted punching or forming tool (e.g., a tool for producing beads, extruded holes, or gills) 3. The punching or forming tool 3 includes upper and lower punching or forming tools 3*a* and 3*b* between which the sheet metal 2 is disposed. Reference numeral 5 designates the stationary receptacle for the lower punching or forming tool (e.g., female mold) 3*b*. The forming tool serves, for example, for generating beads, extruded holes, or gills.

A stationary spray device 6 including a spray nozzle 7 is disposed at a separation distance (e.g., 100 mm) from the center of the lower punching or forming tool 3*b* laterally next to the receptacle 5, for spraying lubricant 8 (e.g., an oil stain) in a pattern having a diameter, b, onto the lower side of the sheet metal sheet 2. The spray device 6 can be connected to a pressurized oil container 10 via a 2/2 way valve 9 that can be electrically actuated. By applying current to the valve 9, pressurized oil is transported to the spray nozzle 7 and is mixed at the nozzle outlet with an air flow and is sprayed onto the sheet metal 2. This air-oil mixture is sprayed onto a sheet metal position to be formed at a separation distance, a, from the working location of the replaced lower punching or forming tool 3*b*. The lubricated position on the sheet metal sheet then is transported to the punching or forming tool 3 during further processing.

Figure 2:
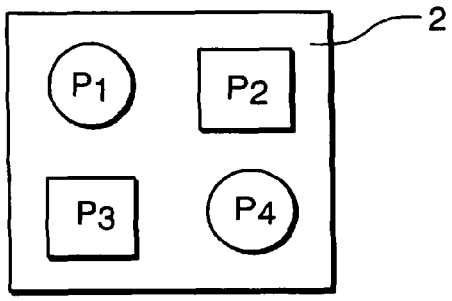
FIG. 2 is a top view onto a piece of sheet metal to be processed at different positions.

FIG. 2 shows as an example four processing positions P1, P2, P3, and P4 on the sheet metal sheet 2 that are to be processed with the combined punching and forming machine 1. The positions P1 and P4 are to be punched with a first punching tool and to be formed with a first forming tool, and the positions P2 and P3 are to be punched with a second punching tool and to be formed with a second forming tool. The sequence of all processing steps is selected to reduce the overall processing time to a minimum. This optimization involves determination of the subsequent position on the sheet metal sheet that can be reached within the shortest time starting from the current position on the sheet metal sheet (i.e., the starting position). The time required for repositioning is calculated from the path of displacement and acceleration along the displacement axes. The positions on the sheet metal sheet 2 available to be selected as the subsequent positions on the sheet metal sheet may differ. Usually, only positions on the sheet metal sheet 2 can be selected that can be reached without a tool change. Positions on the sheet metal sheet 2 that require lubrication prior to processing are available only after lubrication of the position. Lubricating positions for subsequent processing (e.g., after a tool change) or lubricating all positions that are involved in the course of the overall sheet metal processing also may be selected.

The diameter, b, of the sprayed lubricant 8 can be, for example, about 30 mm. If larger surfaces or longer paths are to be lubricated, for example, for nibbling processing, the sheet metal can be moved correspondingly during the spraying process.

Figure 3:
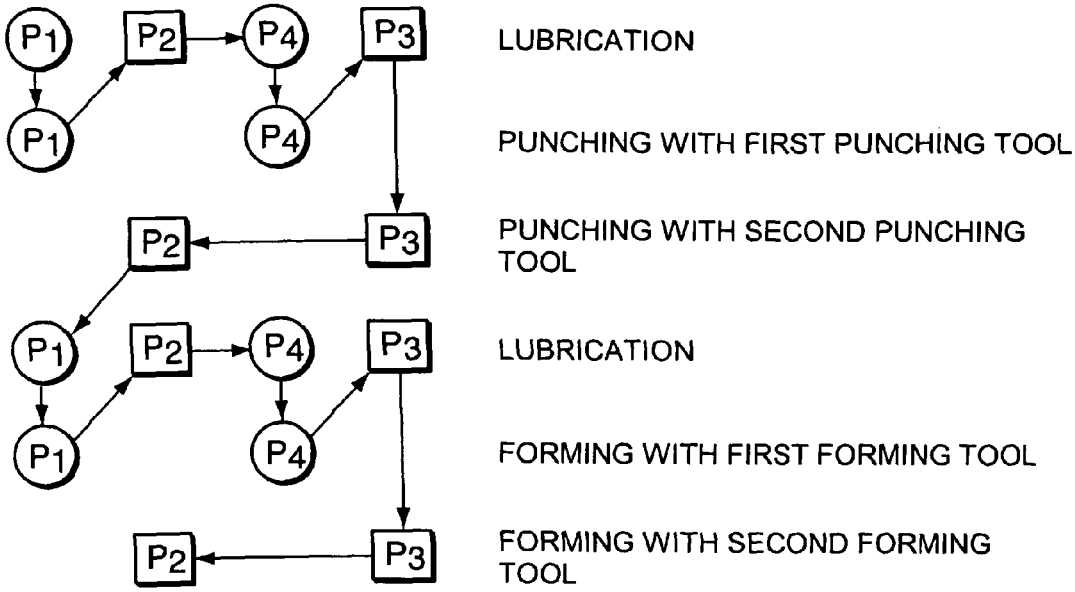
FIG. 3 is an exemplary flow chart of a method for processing the sheet metal shown in FIG. 2 using the punching and forming machine.

FIG. 3 shows a flow chart of processing steps used when processing the sheet metal sheet 2. The sequence of the processing steps is optimized to achieve a minimum overall processing time. As shown in the flow chart, the sheet metal sheet 2 is displaced for lubricating a position on sheet metal sheet until the position is disposed above the spraying nozzle 7. For punching or forming of a position on the sheet metal sheet 2, the sheet metal sheet 2 is displaced until the position is correspondingly disposed in the tool 3. Multiple individual processing steps are implemented by a control unit (e.g., a computer) of the machine 1 controlled by a processing program (e.g., a computer program or software) that controls the method and processing of the sheet metal sheet 2.

When the first punching tool is installed, the position P1 on a sheet metal sheet is initially lubricated and punched with the first punching tool, followed by lubricating of the position P2 on the sheet metal sheet. The position P4 on the sheet metal sheet is subsequently lubricated and punched with the first punching tool, followed by lubricating of the position P3 on the sheet metal sheet. After a tool change to a second punching tool, the positions P3 and P2 on the sheet metal sheet are punched with the second punching tool. After a tool change to a first forming tool, the position P1 on the sheet metal sheet is lubricated and formed, followed by lubricating of the position P2 on the sheet metal sheet. The position P4 on the sheet metal sheet is then lubricated and formed with the first forming tool, followed by lubricating of the position P3 on the sheet metal sheet. After a tool change to a second forming tool, the positions P3 and P2 on the sheet metal sheet are punched with the second forming tool.

The position of the spraying nozzle 7 at a separation distance, a, from the punching or forming center produces a dead zone on one side of the sheet metal sheet 2 that cannot be lubricated. If processing in this dead zone requires lubrication, processing can be carried out alternately in the region that can be lubricated and in the region that cannot be lubricated. This ensures that sufficient lubricating film remains on the tool from the last lubricated processing.

A number of implementations have been described. Nevertheless, it will be understood that various modifications may be made. Accordingly, other implementations are within the scope of the following claims.

What is claimed is:

1. A method of processing a metal sheet with a combined punching and forming machine that comprises a punching tool and a forming tool, the method comprising:

spraying a lubricant onto a lower side of the metal sheet at a first position to be formed on the metal sheet at a lateral distance from a working location of the forming tool;

processing the metal sheet at a second position on the metal sheet by forming or punching the metal sheet; and thereafter moving the lubricated first position on the metal sheet to the working location and forming the metal sheet at the lubricated first position by deforming a portion of the metal sheet with the forming tool.

2. The method of claim 1, wherein processing the metal sheet at the second position comprises forming the metal sheet at the second position.

3. The method of claim 1, wherein the second position is a non-lubricated position.

4. The method of claim 1, wherein processing the metal sheet at the second position comprises punching the metal sheet at the second position.

5. The method of claim 1, further comprising:

spraying the lubricant onto a lower side of the metal sheet with the spraying device at a third position on the metal sheet;

processing the metal sheet at a fourth position on the metal sheet; and thereafter punching the metal sheet at the lubricated third position with a punching tool.

6. The method of claim 1, further comprising:

punching the metal sheet at a plurality of positions;

forming the metal sheet at a plurality of positions;

spraying the lubricant onto a lower side of the metal sheet with the spraying device at a third position and a fourth position on the metal sheet;

processing the metal sheet at a plurality of positions, more than one-third of which have been lubricated; and thereafter forming the metal sheet at the lubricated third and fourth positions on the metal sheet.

7. The method of claim 1, further comprising forming the metal sheet at a plurality of positions on the metal sheet without changing forming tools.

8. The method of claim 1, further comprising punching the metal sheet at a plurality of positions on the metal sheet without changing tools.

9. The method of claim 8, further comprising:

forming the metal sheet at a plurality of positions on the metal sheet without changing tools; and performing consecutively a plurality of punching and forming steps that can be carried out without changing tools.

10. The method of claim 1, further comprising:

spraying the lubricant onto a lower side of the metal sheet at a position to be punched;

spraying the lubricant onto a lower side of the metal sheet in a position to be formed;

after spraying the lubricant onto the position to be formed, forming the metal sheet at the position to be formed on the metal sheet; and after spraying the lubricant onto the position to be punched, punching the metal sheet at the position to be punched on the metal sheet.

11. The method of claim 1, further comprising selecting a subsequent position to be processed on the metal sheet that can be reached within the shortest amount of time from a current position on the metal sheet being processed as the next position on the metal sheet to be processed.

12. The method of claim 1, wherein forming the metal sheet produces beads, extruded holes, and gills.

13. The method of claim 1, wherein the lubricant is sprayed onto the metal sheet in a pattern.

14. The method of claim 13, wherein the pattern has a diameter of about 30 mm.

15. The method of claim 1, wherein lubricant is sprayed onto on a lower side of the metal sheet at only every second or third forming or punching process position.

* * * * *